US006986396B2

(12) United States Patent
Hemphill

(10) Patent No.: US 6,986,396 B2
(45) **Date of Patent: *Jan. 17, 2006**

(54) METHOD FOR DETERMINING SWEEP EFFICIENCY FOR REMOVING CUTTINGS FROM A BOREHOLE

(75) Inventor: Alan Terry Hemphill, Sugar Land, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 179 days.

This patent is subject to a terminal disclaimer.

(21) Appl. No.: 10/669,042

(22) Filed: Sep. 23, 2003

(65) Prior Publication Data

US 2004/0060738 A1 Apr. 1, 2004

Related U.S. Application Data

(63) Continuation of application No. 09/997,677, filed on Nov. 29, 2001, now Pat. No. 6,662,884.

(51) Int. Cl.
*E21B 21/08* (2006.01)

(52) U.S. Cl. ..... 175/48; 175/46; 175/50

(58) Field of Classification Search ..... 175/46, 175/48, 207–218, 50

See application file for complete search history.

(56) References Cited

U.S. PATENT DOCUMENTS

| | | | |
|---|---|---|---|
| 4,168,755 | A | 9/1979 | Willis |
| 4,413,511 | A | 11/1983 | Godbey |
| 5,458,192 | A | 10/1995 | Hunt |
| 6,234,250 | B1 | 5/2001 | Green et al. |
| 6,266,619 | B1 | 7/2001 | Thomas et al. |
| 6,290,001 | B1 | 9/2001 | West et al. |
| 6,357,536 | B1 | 3/2002 | Schrader et al. |
| 6,531,868 | B2 | 3/2003 | Prammer |

OTHER PUBLICATIONS

C.D. Ward and E. Andreassen, "Pressure While Drilling Data Improves Reservoir Drilling Performance," SPE/!IADC 37588, presented at the 1997 SPE/IADC Drilling Conference held in Amsterdam, The Netherlands, Mar. 4-6, 1997.

Ph. A. Charlez, M. Easton, G. Morrice, and P. Tardy Cenergys, "Validation of Advanced Hydraulic Modeling Using PWD DAta," OTC 8804, presented at the 1998 Offshore Technology Conference held in Houston, Texas May 4-7, 1998.

Patrick Isambourg, D.L. Bertin, and Martial Brangetto, "Field Hydraulic Tests Improve HPHT Drilling Safety and Performance," SPE Drilling and Completion 14 (4), Dec. 1999.

D.J. Power, C.Hight, D. Weisinger, and C.Rimer, "Drilling Practices and Sweep Selection for Efficient Hole Cleaning in Deviated Wellbores," SPE 62794, presented at the 2000 IADC/SPE Asia Pacific Drilling Technology held in Kuala Lumpur, Malaysia Sep. 11-13, 2000.

"High-Density Sweep Removes Cuttings," Hart's E&P, Sep. 2001, p. 22.

*Primary Examiner*—Zakiya Walker
(74) *Attorney, Agent, or Firm*—Craig W. Roddy; Karen B. Tripp

(57) ABSTRACT

A new method for evaluating the efficiency of a sweep for removing cuttings from a borehole in a subterranean formation during a drilling operation. The method evaluates sweep efficiency on a "mass" in versus "mass out" basis. The method uses downhole density readings taken with a pressure-while-drilling tool inserted in the drill string. Measurements of hydrostatic pressure are converted into equivalent circulating density measurements which in turn are used in calculating the sweep efficiency. The method affords real time estimates at the wellsite of the quantity of formation cuttings brought out of a wellbore by a sweep.

7 Claims, 1 Drawing Sheet

METHOD FOR DETERMINING SWEEP EFFICIENCY FOR REMOVING CUTTINGS FROM A BOREHOLE

RELATED APPLICATION

This application is a continuation of U.S. patent application Ser. No. 09/997,677, of Alan Terry Hemphill, filed Nov. 29, 2001, now U.S. Pat. No. 6,662,884 and entitled "Method for Determining Sweep Efficiency for Removing Cuttings From a Borehole", pending, the content of which is incorporated herein by reference.

BACKGROUND OF THE INVENTION

1. Field of the Invention

This invention relates to treatments for cleaning boreholes in a subterranean formation and particularly to sweeps for removing cuttings from boreholes. More particularly, this invention relates to methods for evaluating the efficiency or effectiveness of sweeps for removing cuttings from boreholes.

2. Description of Relevant Art

Rotary drilling methods employing drilling apparatus having a drill bit and drill stem have long been used to drill boreholes or wellbores in subterranean formations. Drilling fluids or muds are commonly circulated in the well during such drilling to serve a number of functions, including cooling and lubricating the drilling apparatus, counterbalancing the subterranean formation pressure encountered, and removing drill cuttings from the formation out of the wellbore. In removing drill cuttings from the well, drilling fluids suspend the cuttings and carry them to the surface for removal from the well.

Drilling deviated, horizontal and extended-reach wells has become increasingly common in the oil and gas industry. In drilling such wells, gravity causes deposits of drill cuttings, and especially fines or smaller sized cuttings, to build up along the lower or bottom side of the wellbore. Such deposits are commonly called "cuttings beds." As used herein, the term "deviated" with respect to wells shall be understood to include any well at sufficient angle or deviation off of vertical that cuttings beds tend to form during the drilling operation. "Deviated" wells shall be understood to include without limitation "angled," "high-angled," "oval," "eccentric," "directional," and "horizontal" wells, as those terms are commonly used in the oil and gas industry. The terms "well," "wellbore" and "borehole" are synonymous unless indicated otherwise.

Cleaning (i.e., removing drill cuttings from) a deviated well, particularly drilled at a high angle, can be difficult. Limited pump rate, eccentricity of the drill pipe, sharp build rates, high bottom hole temperature and oval shaped wellbores can all contribute to inadequate hole cleaning. In turn, inadequate hole cleaning can lead to cuttings bed build-up in the wellbore, because commonly used drilling fluids can sometimes fail to remove cuttings from cuttings beds while circulating through the wellbore.

Even in vertical wells, the drilling fluid is not always able to remove drill cuttings efficiently and consequent accumulation can occur. Buildup of cuttings beds can lead to undesirable friction and possibly to sticking of the drill string. Such buildup is especially a problem in extended-reach drilling and in wells using invert emulsion type drilling fluids.

Well treatments or circulation of fluids, called sweeps or sometimes pills, specially formulated to remove these cuttings beds (and other cuttings that would normally not be brought out of the wellbore by the base drilling fluid system) are periodically used to prevent buildup to the degree that the cuttings or fines interfere with the drilling apparatus or otherwise with the drilling operation. These sweeps typically have Theological or density properties significantly different from those of the base drilling fluid system being used, and these sweeps or pills typically are formulated in small volumes (e.g., less than 150 bbl).

Sweeps are commonly applied in vertical as well as in deviated and extended reach drilling applications. The following basic types of sweeps are used in the field: low viscosity; high viscosity; high density; and tandem sweeps comprised of any two of these three preceding types of sweeps. Depending on the nature of a specific drilling operation, sweeps are used to augment cleaning in intervals ranging from a few hundred feet to over 35,000 feet in length (or depth) and at angles ranging from 0° to about 90° from vertical. Commonly, the drilling operation must be stopped while such treatment fluids are swept through the wellbore to remove the fines. However, U.S. Pat. No. 6,290,001 for "Method and Composition for Sweep of Cuttings Beds in a Deviated Borehole" of West et al., assigned to Halliburton Energy Services, Inc., discloses a sweep material and method that can be used without stopping the drilling operation.

The drilling literature contains many references to the use of sweeps and their successes and failures in specific applications. Determining whether a particular type of sweep will bring out large volumes of cuttings from wells has been hard to predict and thus the choice of a particular sweep for a particular operation may be difficult. Often a trial and error procedure is used to decide which type or types of sweeps should be used and how often the sweeps should be used.

Visual estimates of quantities of drill cuttings removed from a well with drilling fluid are commonly made to ascertain the need for a sweep and then to ascertain the effectiveness of the sweep. Sometimes cuttings are collected below the separation shakers and quantities of cuttings wet with drilling fluid are measured on a volume or weight basis.

These methods of evaluating the effectiveness of sweeps are known to have problems or deficiencies. The common method of using an individual's perception of the quantities of drill cuttings coming across the shakers is subject to inaccuracies due to the subjective nature of the method. Two or more individuals seeing the same phenomenon may estimate the quantities of cuttings quite differently. The method involving collection of cuttings in boxes and measuring their volume as a function of time (e.g., the number of seconds or minutes to fill up a box of a given volume) can be quite labor intensive. The volumes must be converted to an estimate of drill cuttings collected on a weight basis by running laboratory tests to determine the amount of liquid drilling fluid adhering to a given weight of cuttings. Often when invert emulsion drilling fluids are used, the drilling mud contains a base oil, weighting material, formation samples, water, and a salt dissolved into the water to obtain desired drilling fluid properties. The laboratory work and the various calculations needed to determine the dry mass of the formation cuttings inherently contain errors that reduce the accuracy of the final estimate of dry cuttings. Further, any fine cuttings that pass through the separation shaker screens will not be collected in the cuttings boxes nor will they be visible to an individual watching drill cuttings pass over the separation shakers.

Modeling of drilling fluid circulating hydraulics to incorporate the effects of sweeps can also be done. Such models are usually sophisticated and many produce results within a reasonable range of error. However, known models do not rely on actual measurement of drilling fluid density or drill cuttings concentration in the annulus.

There continues to be a need for improved methods for determining the effectiveness and efficiency of sweeps in removing residual cuttings and cuttings beds from a wellbore during a drilling operation.

SUMMARY OF THE INVENTION

The present invention provides a method for determining the effectiveness of sweeps in removing cuttings from a wellbore. The method has the advantage over the prior art of affording such determination at the wellsite. Further, the determination is based on data measured directly at the wellbore, preferably data taken with a pressure-while-drilling (PWD) type of tool or with a mass flow meter, without reliance on a particular person's subjective perception or on time-consuming, labor intensive cuttings collection methods of the prior art that introduce errors. The data may also be used in a computer program, preferably for a computer at the wellbore, so that estimates of sweep efficiency can be made on a real-time or near real-time basis.

The present invention may be used to determine not only the effectiveness of a single sweep but also of tandem sweeps or to compare the results of different types of sweeps in a wellbore.

In the method of the invention, sweep efficiency is gauged from estimating the amount of drill cuttings removed by a sweep from a wellbore. A "mass in" measurement of the sweep is obtained. The "mass in" is the mass of the sweep (or of the drilling fluid with the sweep if the sweep will be mixed with the drilling fluid and used as the well is continually drilled rather than introduced into the wellbore separately as a "pill") when the sweep is pumped into the wellbore. Downhole density readings of the sweep are taken as a function of time (mass flow rate), as the sweep and its entrained drill cuttings move up the annulus and out of the well. Preferably, a pressure-while-drilling tool (or other tool providing density readings or measurements), and/or a mass flow meter, is used to obtain this density data. This data is converted into a "mass out." The sweep efficiency if then calculated by subtracting "mass in" from "mass out".

DETAILED DESCRIPTION OF PREFERRED EMBODIMENTS

In the method of the invention, the volume, density and Theological properties of the sweep and the base drilling fluid are preferably measured at the well surface. For greater accuracy, particularly when the base drilling fluid comprises all oil or an invert emulsion, these properties preferably should be adjusted as a function of downhole pressure and temperature. Preferably, before the sweep is pumped into the wellbore, a baseline Equivalent Circulating Density (ECD) for the sweep is measured.

The ECD measurement may be made with a pressure-while-drilling (PWD) tool inserted in the drill string. This tool contains a pressure gauge that reads hydrostatic pressure down to the point where the sensor is placed. Preferably the sensor is placed below a point or depth in the wellbore where cuttings beds to be swept by the sweep are believed to be located. The hydrostatic pressure measured by the PWD tool is converted into ECD units by using the time vertical depth (TVD) at the point in the wellbore where the PWD sensor is located. The calculated ECD values include not only the circulating drilling fluid density but also the functional pressure required to push the drilling fluid and the entrained drilled formation cuttings out of the wellbore. This information can be collected on a real-time or near real-time basis, and has been used to optimize drilling parameters such as rates of operation, pump output rate, and non-drilling circulation time. An example article discussing information obtained with PWD tools as known in the industry is "Pressure While Drilling Data Improves Reservoir Drilling Performance", by C. Ward and E. Andreassen, SPE paper 37588, presented at the 1997 SPE/IADC Drilling Conference in Amsterdam, Mar. 4–6, 1997, incorporated herein by reference.

As the sweep is being pumped into the wellbore, the volumetric flow rate/mass flow rate of the sweep is measured. As the sweep and its entrained drill cuttings move up the annulus, PWD tool readings of hydrostatic pressure are made as a function of time. The specific gravity of the formation being drilled (or when cuttings having two or more different specific gravity levels are being drilled and cleaned out of the wellbore, the average specific gravity of cuttings collected at the separation shakers) is also determined.

Figure 1:
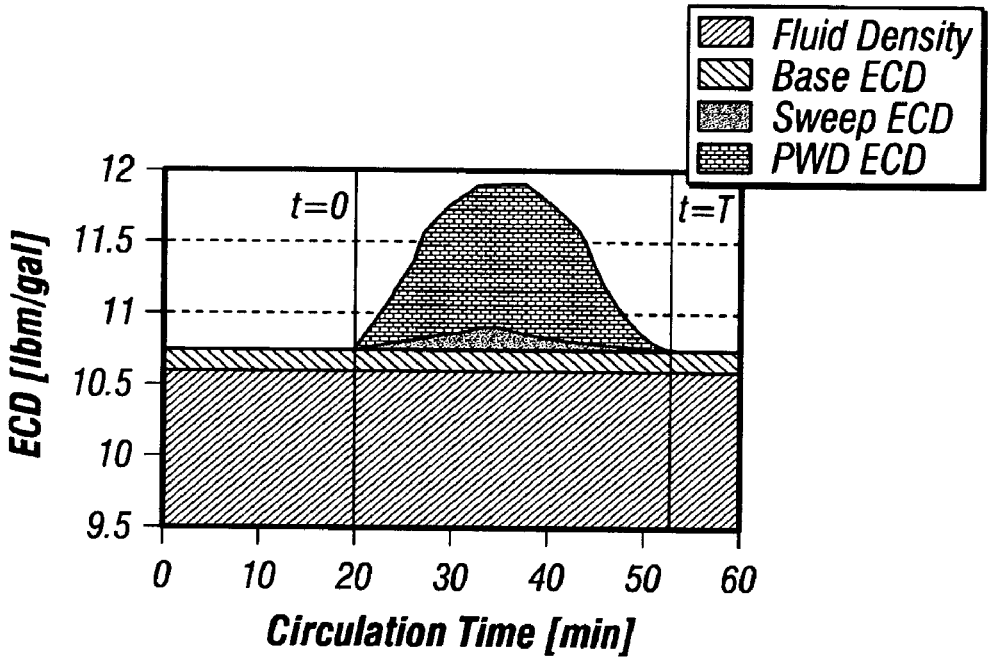
FIG. 1 is a schematic of sweep efficiency responses taken from section of a PWD log for a period pertinent to the pumping of a sweep at a wellsite.

FIG. 1 is a section of a PWD log for the period related to the pumping and circulation of a sweep in a borehole. This figure shows typical responses of sweeps in PWD logs as a function of pumping time. The begin time, t=0, is the time at which the effects of the sweep first appear on the PWD data. The end time, T, is the time at which the effects of the sweep disappear from the PWD data. Area 1 is the measured fluid density multiplied by time (T–t) [eg, mass flow rate]. Area 2 is the pressure loss of the base fluid circulating system converted to ECD units for the same time period as described above. In Area 2, any sweep effects on ECD are not relevant. Area 1 and Area 2 added together give the total mass flow rate of the base fluid circulating system for the time (T–t). Area 3 is the additional contribution of the sweep to ECD calculated using the density and rheological properties of the sweep multiplied by time (T–t). The contribution to Area 3 mass flow rate by the sweep viscosity can be calculated at the wellsite when the sweep exits the wellbore or can be imported from hydraulics modeling. Example articles discussing such modeling as known in the industry and incorporated herein by reference are "Validation of Advanced Hydraulic Modeling Using PWD Data", by P. Charlez, M. Easton, G. Morrice, and P. Tardy, OTC paper 8804, presented at the 1998 Offshore Technology Conference in Houston, May 4–7, 1998, and "Field Hydraulic Tests Improve HPHT Drillng Safety and Performance", by P. Isambourg, D. Bertin, and M. Branghetto, SPE *Drilling & Completion* 14 (4), December 1999. The viscosity-related part of Area 3 is usually relatively small in relation to the other areas. Area 4 is the additional mass flow rate resulting from the incorporation of drill cuttings brought out of the wellbore by the sweep. The sum of all of the responses (Areas 1–4) is the total mass flow rate calculated from the pressure losses measured by the PWD tool for the time (T−t). Efficiency of the sweep (SE) is determined from Area 4. It can be calculated by the following integral formula, which is a summation of the ECD responses from the PWD tool over a given amount of time:

$$ECD\ \text{total} = \int_{t=0}^{T} ECD$$

Area 4=Mass Flow $\text{Rate}_{Total}$−Area 1−Area 2−Area 3

SE=Area 4÷pump rate [Sweep efficiency units are in units of mass.]

With these input parameters in hand, the user can readily produce an estimate of formation cuttings brought out of the wellbore by the sweep. Sweep efficiencies of multiple sweep runs in the field can thus be estimated and compared to determine whether hole cleaning is improving or deteriorating with time.

For example, a particular high weight sweep (HW3) might have input parameters as follows: circulation system density [lbm/gal]=9.4; circulation system ECD [lbm/gal eq]—steady state=10.75; pump rate [US gal/min]=90; sweep density [lbm/gal]=12.3; sweep viscosity [cP]=85; and sweep volume [bbl]=10. The calculations for determining sweep efficiency would then be as follows: mass flow rate from PWD [lbm/gal] * [min]=23.85; mass flow rate from sweep properties (greater than base fluid density) [lbm/gal] * [min]=13.53; mass flow rate difference [lbm/gal] * [min] =10.32; mass out [lbm]=928.5.

For another example, a particular high viscosity sweep (HV3) might have input parameters as follows: circulation system density [lbm/gal]=9.8; circulation system ECD [lbm/gal eq]—steady state=10.8; pump rate [US gal/min]=120; sweep density [lbm/gal]=9.8; sweep viscosity [cP]=240; and sweep volume [bbl]=7. The calculations for determining sweep efficiency would then be as follows: mass flow rate from PWD [lbm/gal] * [min]=2.38; mass flow rate from sweep viscosity (greater than base fluid density) [lbm/gal] * [min]=2.38; mass flow rate difference [lbm/gal] * [min]=0; mass out [lbm]=0.

Figure 2:
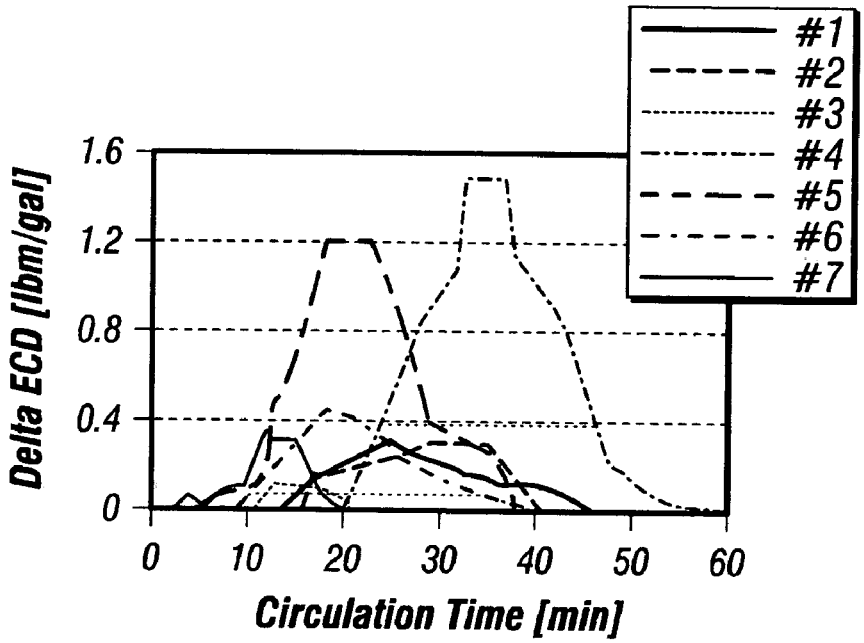
FIG. 2 is a schematic of sweep efficiency responses taken from sections of PWD logs for periods pertinent to the pumping of several sweeps at a wellsite.

In FIG. 2, seven different sweeps in a test wellbore are compared. The results of these sweeps are also summarized in the table below:

Summary of Sweep Performance

| Sweep # Description | Depth (ft) | Pump Rate (gpm) | Volume (bbl) | Density (lbm/gal) | Weight Cuttings Out (lbm) | Weight Cuttings Out (bbl) |
|---|---|---|---|---|---|---|
| 1-HW1 | 3300 | 90 | 5 | 12.0 | 0 | 0 |
| 2-HW2 | 3630 | 90 | 6 | 11.6 | 0 | 0 |
| 3-HV1 | 3750 | 80 | 5 | 9.5 | 13 | 0.015 |
| 4-HW3 | 3816 | 90 | 10 | 12.3 | 929 | 1.04 |
| 5-HV/HW | 1500 | 90 | 8.5 | 13.2 | 90 | 0.1 |
| 6-HV2 | 2925 | 90 | 7 | 9.8 | 470 | 0.53 |
| 7-HV3 | 1500 | 120 | 7 | 9.8 | 0 | 0 |

The sweeps reported in the table above and graphed in FIG. 2 comprised three high viscosity (HV) sweeps, three high weight (HW) sweeps, and one high viscosity/high weight sweep (HV/HW). Three of these cases are discussed below:

HW3 had a higher density than the base fluid density and thus a dotted line in FIG. 2 is used to show the mass flow rate of the sweep density (below the dotted line for the curve for this sweep) and the mass flow rate of the cuttings removed from the wellbore (above the dotted line for the curve for this sweep). Of the 7 sweeps studied, sweep HW3 brought out the highest amount of cuttings.

HV2 performed second-best of the seven sweeps studied. A dotted line in FIG. 2 is used to show the mass flow rate of the sweep resulting from the elevated Theological properties (derived from hydraulic modeling) below the dotted line, and the mass flow rate of the cuttings removed from the wellbore (above the dotted line for the curve for this sweep). Field reports document that sweep HV2 brought out a heavy stream of fine cuttings at the shakers.

For the later field case HV3, the PWD log indicated only a small increase in ECD when the sweep HV3 was circulated out of the hole. According to the method of the invention, the corresponding sweep efficiency was estimated to be near-zero. Nevertheless, notation on the PWD log indicated "heavy returns at the shakers" and an "increase in fine cuttings at the shakers". Sweep efficiency calculations for sweep HV3 indicated that while this sweep may have brought a few cuttings out of the wellbore, the sweep was not nearly as efficient as sweeps HW3 or HV/HW. This test therefore demonstrated the enhanced accuracy of the method of the invention over subjective individual observation.

The calculations above for sweep efficiency include finely sized drill cuttings that can pass through screens of separation shakers, as well as cuttings that will typically be captured in such shakers. Thus, the calculations of the invention more accurately include cuttings that prior art methods miss as well as cuttings that prior art methods include or consider.

The data used in the method of the invention can be incorporated into a computer program, preferably for a computer at the wellsite, to enable real-time or near real-time estimates of sweep efficiency.

The information or data obtained accordingly to the method of the invention can be used in planning the use of future sweeps, in increasing or decreasing sweep volume, in increasing or decreasing sweep density, in changing the type of sweep, in planning to run tandem sweeps, etc.

The foregoing description of the invention is intended to be a description of preferred embodiments. Various changes in the details of the described method can be made without departing from the intended scope of this invention as defined by the appended claims.

I claim:

1. A method for measuring in real time or near real time the effectiveness of a sweep for cleaning a borehole drilled with drilling fluid, said method comprising:

providing the volume, density, and at least one rheological property of the drilling fluid;

providing a baseline equivalent circulating density of said drilling fluid;

providing the volume, density, and at least one rheological property of the sweep;

pumping said sweep into said borehole and circulating said sweep in said borehole;

measuring in real time or near real time the downhole density of said sweep during said pumping and during said circulating of said sweep as a function of time and measuring in real time or near real time the pump rate during said pumping;

providing the specific gravity of the subterranean formation;

calculating in real time or near real time the total equivalent circulating density;

determining in real time or near real time the sweep's contribution to the total equivalent circulating density; and calculating in real time or near real time the sweep efficiency.

2. The method of claim 1 further comprising:

determining in real time or near real time the downhole pressure and temperature during said sweep; and adjusting in real time or near real time said volume, density, or at least one rheological property of said drilling fluid or said sweep as a function of said downhole pressure and temperature.

3. The method of claim 1 wherein said baseline equivalent circulating density and said total equivalent circulating density are obtained from measurement of the hydrostatic pressure in the borehole with the time vertical depth of the sweep in the borehole.

4. The method of claim 1 wherein said baseline equivalent circulating density and said total equivalent circulating density are measured with a pressure-while-drilling tool inserted in the drill string.

5. A method for determining in real time or near real time the effectiveness of a sweep for cleaning a borehole drilled employing drilling fluid, said method comprising:

determining in real time or near real time the equivalent circulating density for the drilling fluid before addition of the sweep;

determining in real time or near real time the equivalent circulating density for the drilling fluid with the sweep;

determining in real time or near real time the rate of addition of the sweep into the borehole; and calculating in real time or near real time the sweep efficiency using the formula:

$$SE = \frac{ECD_{Total} - ECD_{Base}}{\text{pump rate}}$$

where SE is sweep efficiency and ECD is equivalent circulating density.

6. The method of claim 5 wherein said equivalent circulating density is obtained from measurement of the hydrostatic pressure in the borehole with the time vertical depth of the sweep in the borehole.

7. The method of claim 5 wherein said equivalent circulating density is measured with a pressure-while-drilling tool inserted in the drill string.

* * * * *